US007787816B2

(12) United States Patent
Kladias et al.

(10) Patent No.: US 7,787,816 B2
(45) Date of Patent: Aug. 31, 2010

(54) THERMALLY UNIFORM PAPER PREHEAT TRANSPORT

(75) Inventors: Nicholas Kladias, Flushing, NY (US); Gerald A Domoto, Briarcliff Manor, NY (US); Igor A Podzorov, Webster, NY (US); Paul M Fromm, Rochester, NY (US); Anthony S Condello, Webster, NY (US); Augusto Barton, Webster, NY (US); Charles D Rizzolo, Fairport, NY (US); Elias Panides, Whitestone, NY (US)

(73) Assignee: Xerox Corporation, Norwalk, CT (US)

( * ) Notice: Subject to any disclaimer, the term of this patent is extended or adjusted under 35 U.S.C. 154(b) by 427 days.

(21) Appl. No.: 11/935,576

(22) Filed: Nov. 6, 2007

(65) Prior Publication Data

US 2009/0116888 A1 May 7, 2009

(51) Int. Cl.

| | |
|---|---|
| ***G03G 15/00*** | (2006.01) |
| ***G03G 15/20*** | (2006.01) |
| ***G03G 21/20*** | (2006.01) |

(52) U.S. Cl. ..... 399/400; 399/68; 399/92; 399/94; 399/322; 399/341

(58) Field of Classification Search ..... 399/68, 399/92, 94, 322, 341, 397, 400
See application file for complete search history.

(56) References Cited

U.S. PATENT DOCUMENTS

| | | | | |
|---|---|---|---|---|
| 6,505,832 | B2 | 1/2003 | Moore et al. | |
| 6,873,821 | B2 * | 3/2005 | Russel et al. | 399/400 |
| 7,010,260 | B2 * | 3/2006 | Behnke et al. | 399/401 |
| 2005/0147454 | A1 * | 7/2005 | Spence et al. | 400/629 |

* cited by examiner

*Primary Examiner*—David M Gray
*Assistant Examiner*—Joseph S Wong
(74) *Attorney, Agent, or Firm*—Lloyd F. Bean, II

(57) ABSTRACT

A pre-heater system and adapted to be used on an electrostatic marking apparatus for improving gloss on media having marking thereon at a location in the apparatus prior to a conventional fuser roll assembly or station, the system including a primary heater adapted to blow pressurized hot air into a surface of an image receiving media in order to substantially dispense hot air throughout an entire paper or media surface; and a preheat media transport for transporting media from the location in the apparatus prior to the conventional fuser roll assembly or station through the primary heater, the preheat media transport includes means for maintaining the preheat media transport at a substantially uniform predefined temperature.

13 Claims, 13 Drawing Sheets

THERMALLY UNIFORM PAPER PREHEAT TRANSPORT

The present disclosure relates generally to an electrostatographic or xerographic printing machine, and more particularly concerns a fixing device and a fixing method of forming an unfixed toner image of an image pattern corresponding to objective image information on a surface of a recording media.

In a typical electrostatographic reproduction process machine, a photoconductive member is charged to a substantially uniform potential so as to sensitize the surface thereof. The charged portion of the photoconductive member is imagewise exposed in order to selectively dissipate charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated at a thermal fusing apparatus at a desired operating temperature so as to fuse and permanently affix the powder image to the copy sheet having a certain gloss. In recent years, in particular, for a full-color image, a demand for an enhancement of image quality by making the image glossy has been increased.

It is highly desirable to have printed images with uniform gloss throughout the entire sheet. To improve gloss on printed images paper preheat modules which consists of a transport belt and a heating device upstream of the fuser module have been employed to extend fusing latitude both in terms of productivity as well as media range. The paper is heated by various means such as convection, radiation, etc. Applicants have found that the paper transport belt is also heated within the gap that exists between consecutive sheets of paper (interdocument zone or IDZ). In a print job consisting of many sheets of paper, if the preheat belt is asynchronous with the page stream, IDZs create hot zones on the transport belt which come around and create high temperature zones within the sheets of paper that come in contact with them. These step changes in the paper temperature and previously fused image contact with the belt can lead to gloss variations (gloss nonuniformity) that are very obvious to the human eye due to the abrupt nature of the temperature change in the process direction.

It is desirable to have a simple apparatus construction, which can generate images with high glossiness and is free from gloss nonuniformity.

SUMMARY

There is provided a pre-heater system and adapted to be used on an electrostatic marking apparatus for improving gloss on media having marking thereon at a location in said apparatus prior to a conventional fuser roll assembly or station, said system including a primary heater adapted to blow pressurized hot air into a surface of an image receiving media in order to substantially dispense hot air throughout an entire paper or media surface; and a preheat media transport for transporting media from the location in said apparatus prior to the conventional fuser roll assembly or station through said primary heater, said preheat media transport includes means for maintaining said preheat media transport at a substantially uniform predefined temperature.

There is also provided a preheat media transport, adapted to be used on an electrostatic marking apparatus, for transporting media adapted from a first station in said apparatus to a second station, said preheat media transport, including an endless belt for transporting media thereon, drive means for driving said endless belt at a predefined velocity; and means for maintaining said endless belt at a substantially uniform predefined temperature.

BRIEF DESCRIPTION OF THE DRAWINGS

Other features of the present invention will become apparent as the following description proceeds and upon reference to the drawings, in which.

DETAILED DESCRIPTION

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG.

1 printing machine will be shown hereinafter schematically and their operation described briefly with reference thereto.

Figure 1:
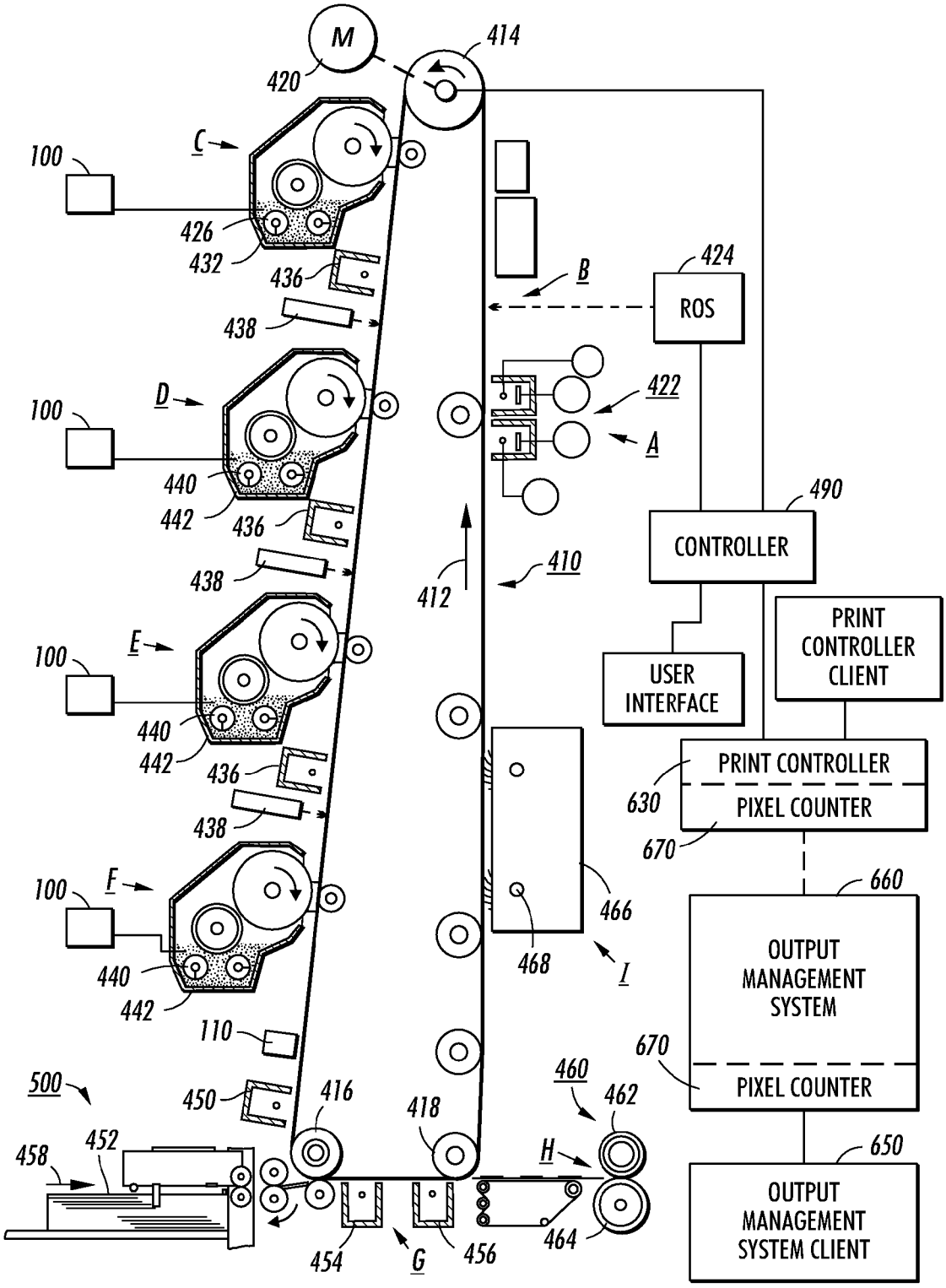
FIG. 1 is a schematic of an example of a digital imaging system, which can employ the media preheat transport of the present disclosure.

FIG. 1 is a partial schematic view of a digital imaging system, such as the digital imaging system of U.S. Pat. No. 6,505,832 which is hereby incorporated by reference. The imaging system is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system, and a black and white printing system.

Referring to FIG. 1, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of photoreceptor belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or developed areas.

At a first development station C, developer structure, indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 200 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles. Further, a toner concentration sensor 200 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor 600 of the present disclosure which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brushes 468 are engaged after the composite toner image is transferred to a sheet.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

It is believed that the foregoing description is sufficient for purposes of the present application to illustrate the general operation of an electrophotographic printing machine incorporating the development apparatus of the present disclosure therein.

Figure 2:
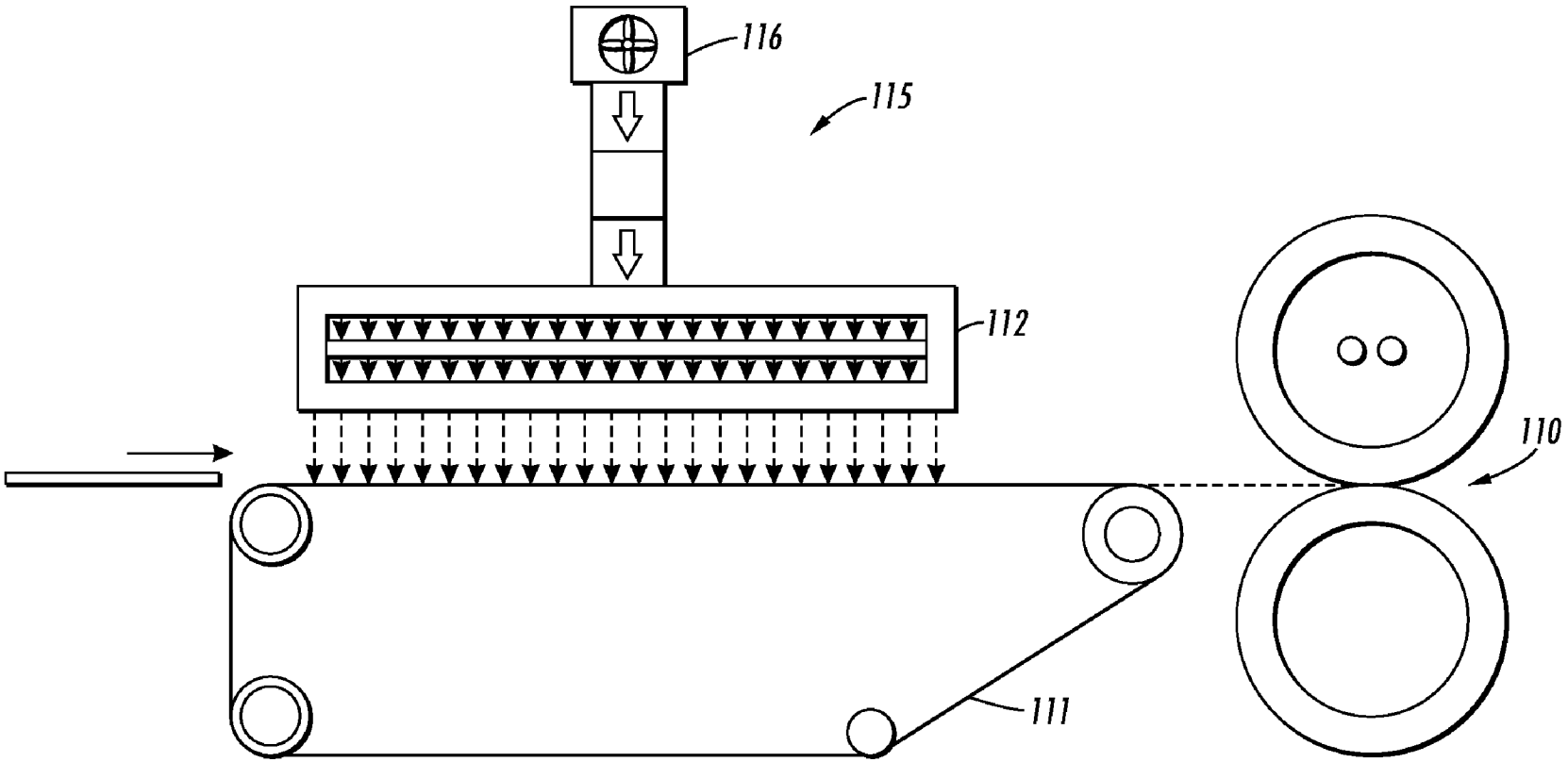
FIG. 2 PRIOR ART
FIG. 2 is a schematic of a prior art media preheat transport.

Referring to prior art FIG. 2, shows a typical paper preheat module 115 the paper is heated by impinging jets of hot air as it is transported to the fuser 110 via a transport belt 111. Paper preheat module 115 employs hot air impingement which is accomplished via heater blower unit 116 connected to member 112 having an array of holes through which the heated air flows. The hole pattern (on the plate of the preheat module) is designed to provide as much heating as possible with sufficient spatial uniformity. Applicants have found with the preheat module configuration that the paper transport belt is also inadvertently heated within the gap that exists between consecutive sheets of paper (inter-document zone or IDZ). In a print job consisting of many sheets of paper, if the preheat belt is asynchronous with the page stream, IDZs create hot zones on the transport belt which come around and create high temperature zones within the sheet of paper that comes in contact with them. These step changes in the paper temperature and previously fused image contact with the belt can lead to gloss variations that are very obvious to the human eye due to the abrupt nature of the temperature change in the process direction.

Figure 3:
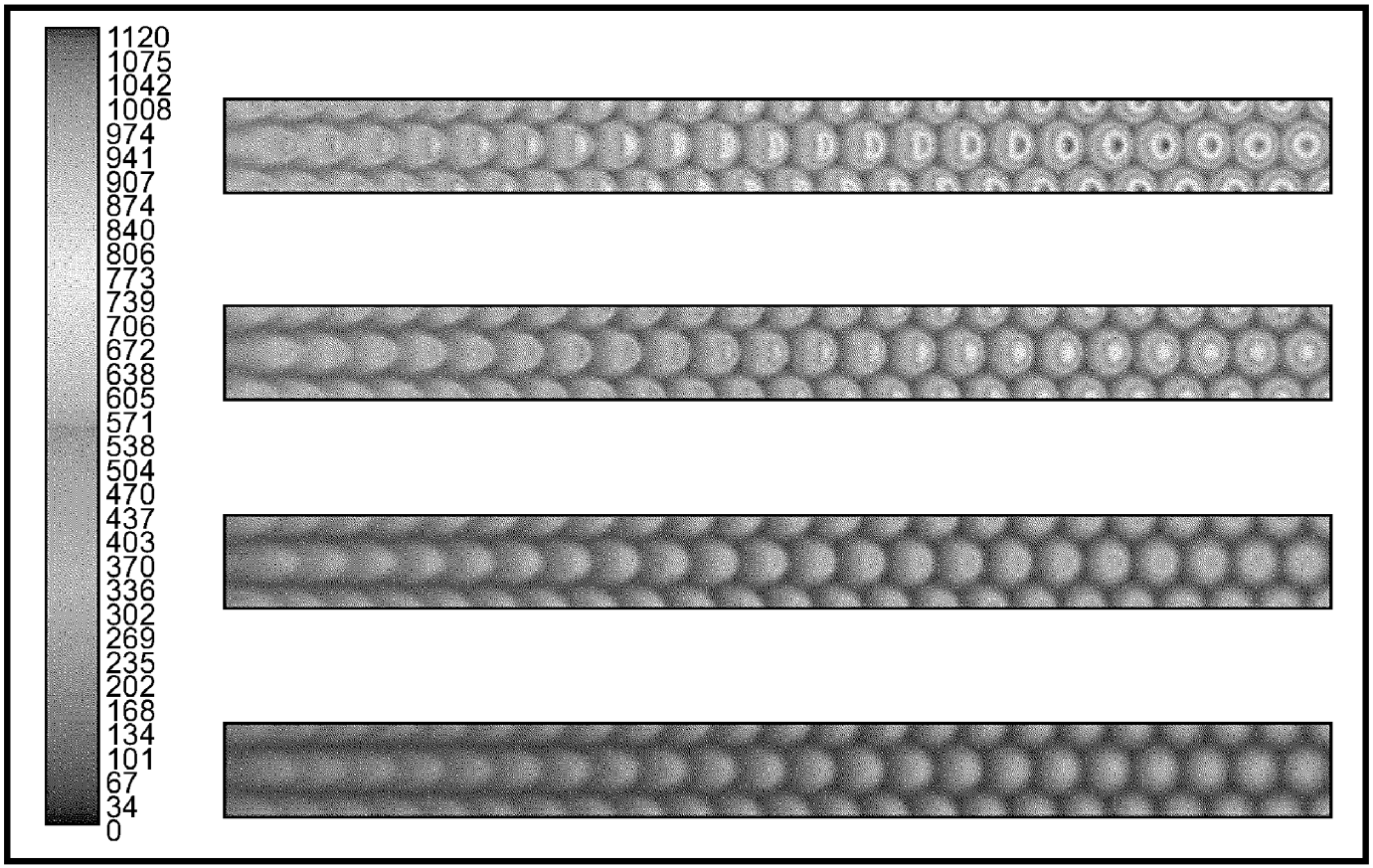
FIG. 3 Prior Art
FIG. 3 shows the spatial distribution of the heat transfer coefficient for various operating conditions (plenum pressures) using the prior art media preheat transport.

FIG. 3 shows the spatial distribution of the heat transfer coefficient for various operating conditions (plenum pressures) using the prior art media preheat transport of FIG. 2. The corresponding flow rates and (spatially) averaged heat transfer coefficients are also shown. These results were used as inputs in the three-dimensional heat transfer simulation of paper preheat.

Figure 4:
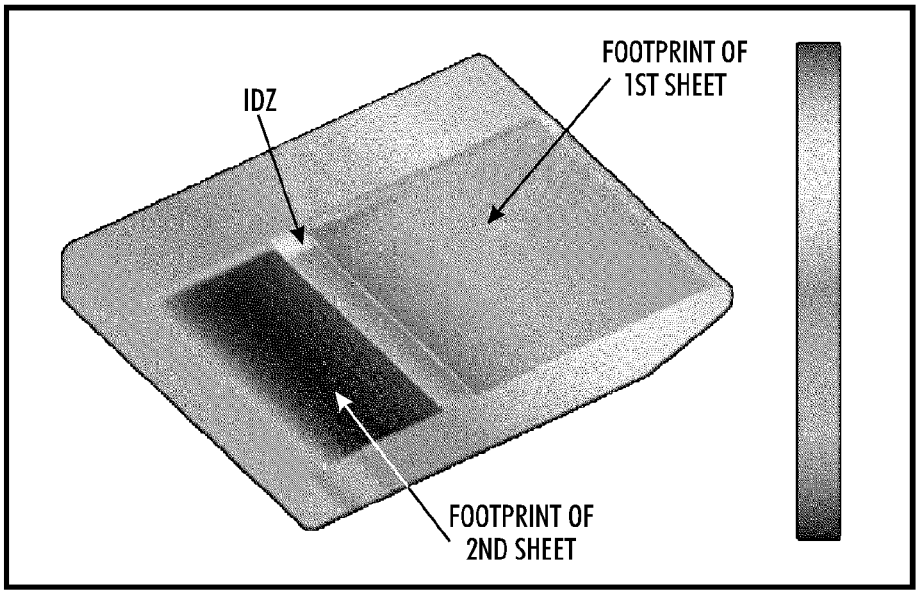
FIG. 4 Prior Art
FIGS. 4 and 5 show results of a numerical simulation of the temperature of the surface of the prior art media preheat transport.
Figure 5:
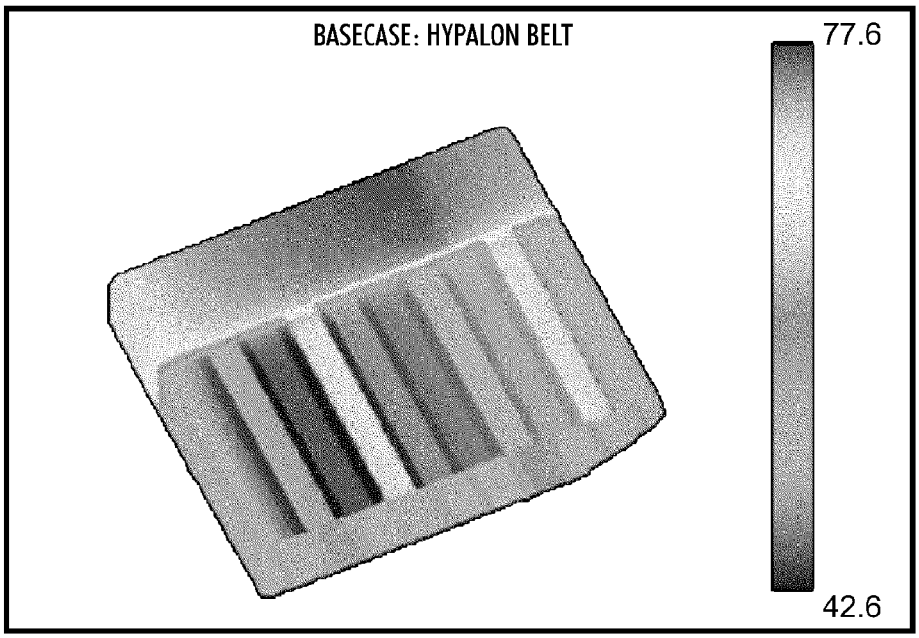
FIG. 5 Prior Art
Figure 6:
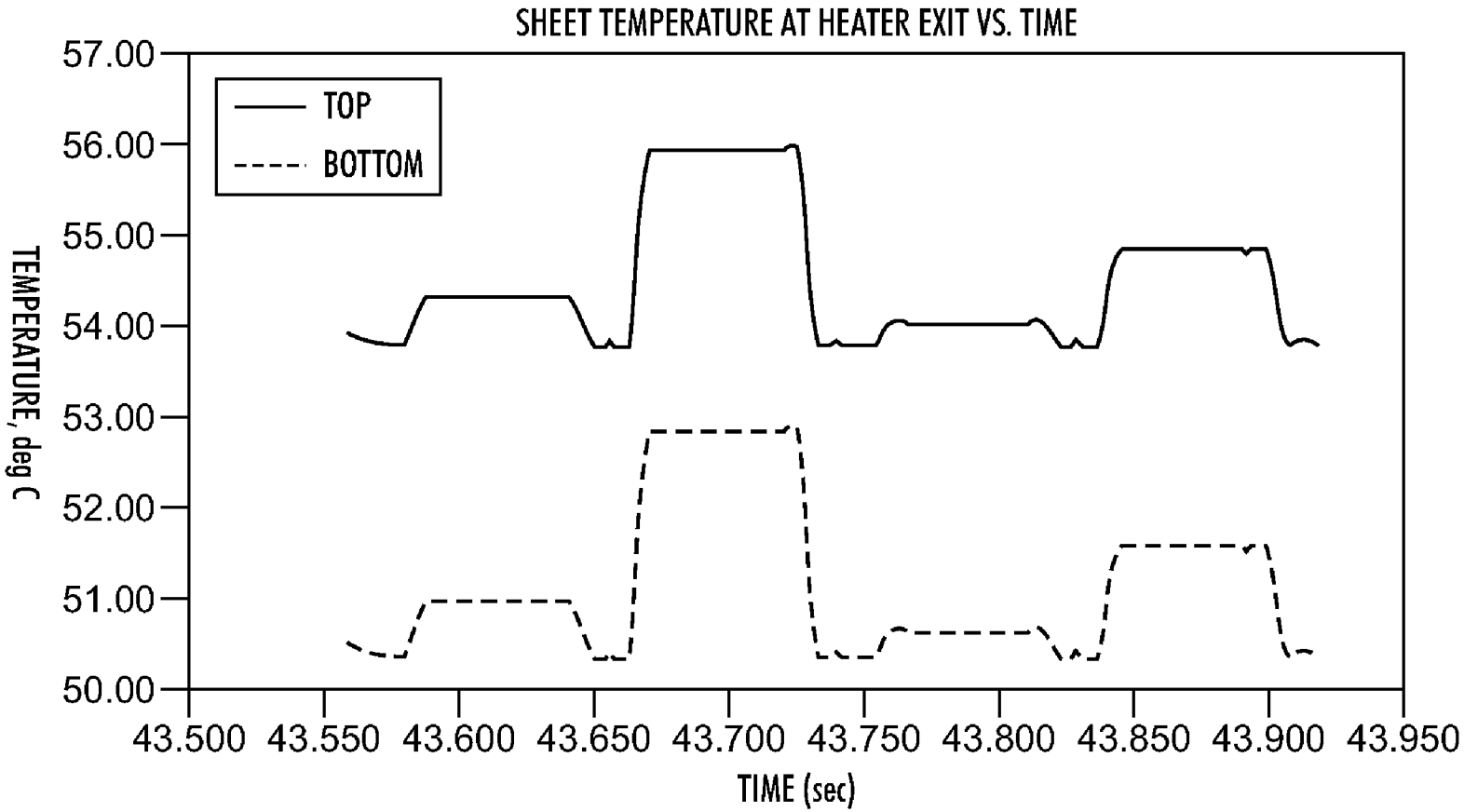
FIG. 6 Prior Art
FIG. 6 shows numerical simulation results as regards the temperature distribution on a sheet of paper at the preheater exit of the prior art media preheat transport.

Typically the transport belt is made of low thermal conductivity material, e.g. hypalon which makes it hard to mitigate temperature variations in the process or lateral directions. Within the inter-document zone (IDZ), the impinging jets of air, directly heat the transport belt as shown in FIG. 4 which shows the temperature of the belt surface from a 3-dimensional numerical simulation of the preheat process for a two page print job where the 2nd page has made it about ⅓ the way through. FIG. 4 clearly shows the heating of the transport belt in the IDZ. FIG. 5 shows the belt surface temperature after a 200 print job. It clearly shows a highly non-uniform temperature distribution and this causes temperature variations within the same paper sheet (see FIG. 6) both at the top (simplex) and bottom (duplex) sides.

Figure 7:
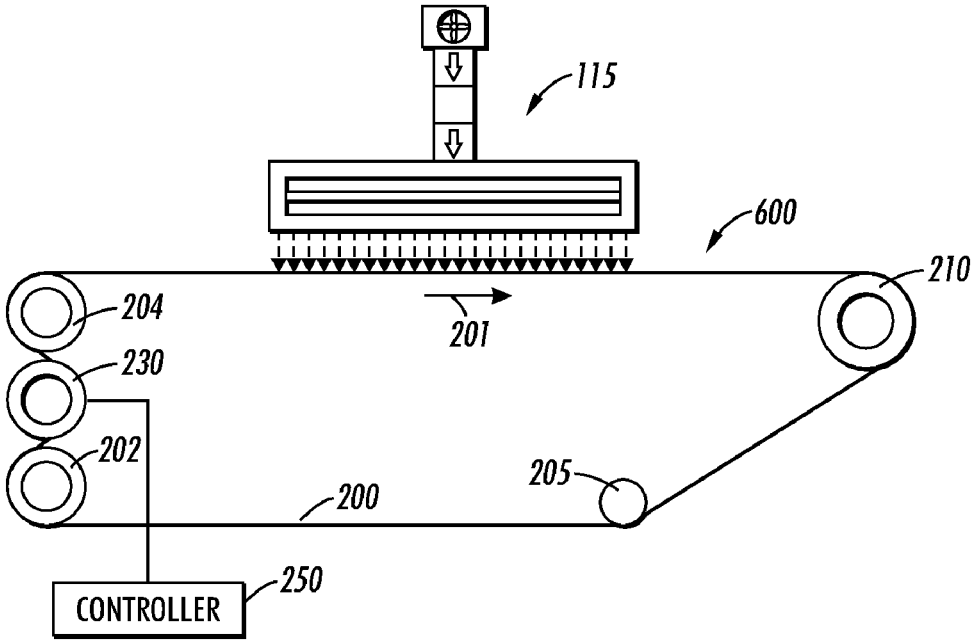
FIG. 7 is a schematic of an embodiment of a media preheat transport of the present disclosure.
Figure 8:
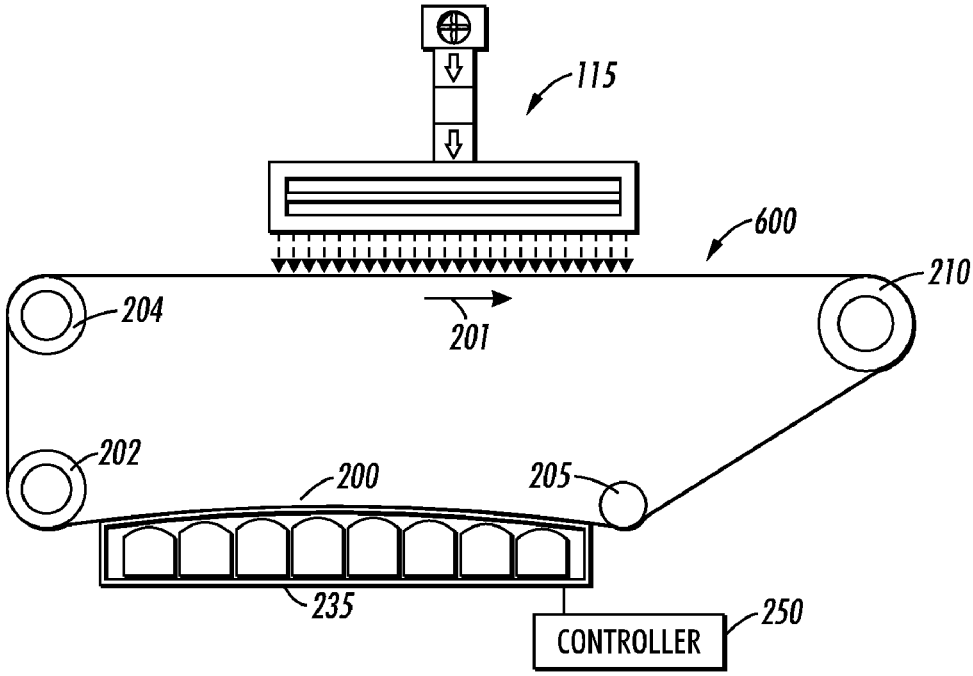
FIG. 8 is a schematic of another embodiment of a media preheat transport of the present disclosure.

Now focusing on the embodiments of the present disclosure referring to FIGS. 7 and 8, there is shown a primary heater 115 adapted to blow pressurized hot air into a surface of an image receiving media in order to substantially dispense hot air throughout substantially an entire paper or media surface on uniform paper preheat transport module 600. Alternatively, the paper can be heated by various means such as convection, radiation, etc. Uniform paper preheat transport module 600 includes a transport belt and a heating device upstream of the fuser module to extend fusing latitude both in terms of productivity as well as media range. The uniform paper preheat transport module 600 of the present disclosure incorporates belt materials, a heat pipe iso-thermalizing roll and/or a cooling/heating shoe to achieve temperature/gloss uniformity for any media type. In addition to fusing extensibility, the uniform paper preheat transport module 600 can be used anywhere in the print process where temperature gradients presented to the media are a risk to image quality (e.g., post fuser media transport, etc). A thermally uniform media transport thus becomes a key enabler for printer extensibility in process speed and media latitude while maintaining or improving image quality.

As shown in FIGS. 7 and 8 uniform paper preheat transport module 600 preferably uses belt 200 supported for movement in the direction indicated by arrow 201. The belt is entrained about a drive roller 210, tension roller 205, and fixed rollers 202 and 204, and the drive roller 210 is operatively connected to a drive motor (not shown) for transporting developed sheets to Fusing station H.

A heat pipe 230 (as shown in FIG. 7) is entrained about belt 200 between rollers 202 and 204. Heat pipe 230 heats belt 200 to a predefined temperature. Alternatively, as shown in FIG. 8, a cooling/heating shoe 235 in contact with the transport belt 200 where a fluid flows through the shoe channels and dumps or extracts heat from the belt depending on the fluid/belt temperatures in response to temperature controller 250. Temperature controller can adjust to belt temperature from a first predefined temperature to a second predefined temperature so that for example as the designated predefined temperature for the type of print media being used.

The transport belt 200 can be composed of, for example, a multi-layer structure made of a base layer and a surface layer. As the surface layer, being composed of a material having a low thermal capacity having a thermal capacity per surface unit area less than 350 $J/m^2$ K, for example, a polymer sheet of polyester, polyethylene terephthalate, polyethersurfone, polyetherketone, polysulfone, polyimide, polyimidoamide, polyamide, or the like may be used. The transport belt 200 also can be composed of a high thermal conductivity material e.g. metal such as nickel, steel, or the like may be used. Transport belt 200 may also include a surface coating of Teflon thereon.

Figure 9:
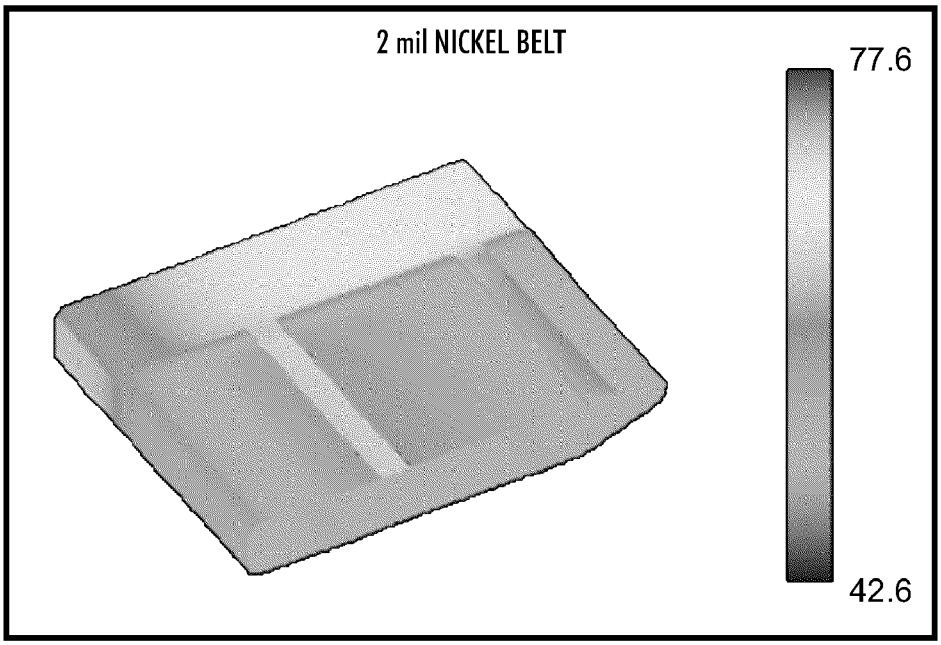
FIGS. 9 and 10 show results of a numerical simulation of the temperature of the surface of a 0.002 in thick Nickel media preheat transport after 200 sheets.
Figure 10:
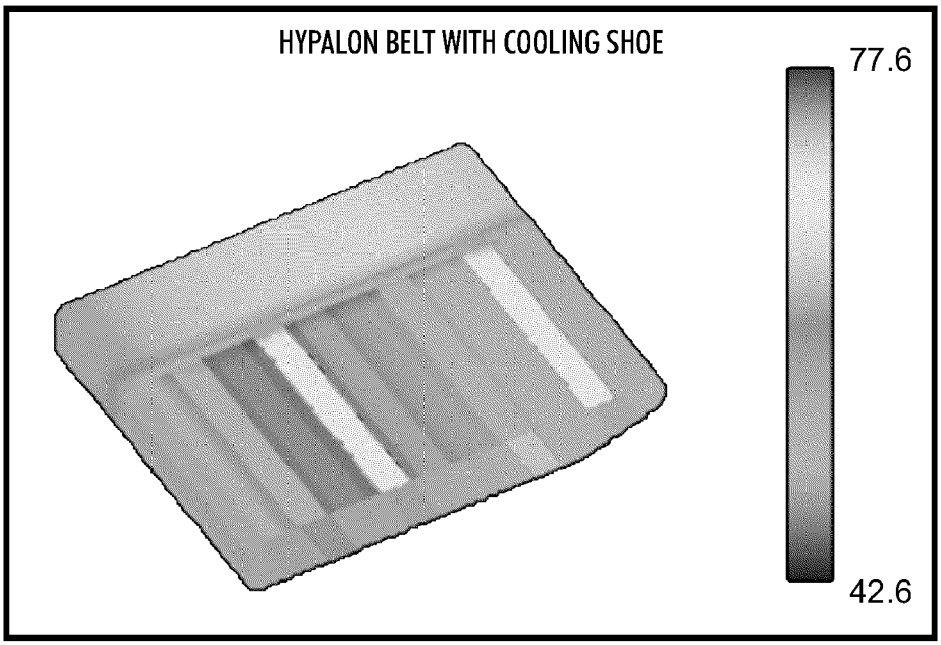
Figure 11:
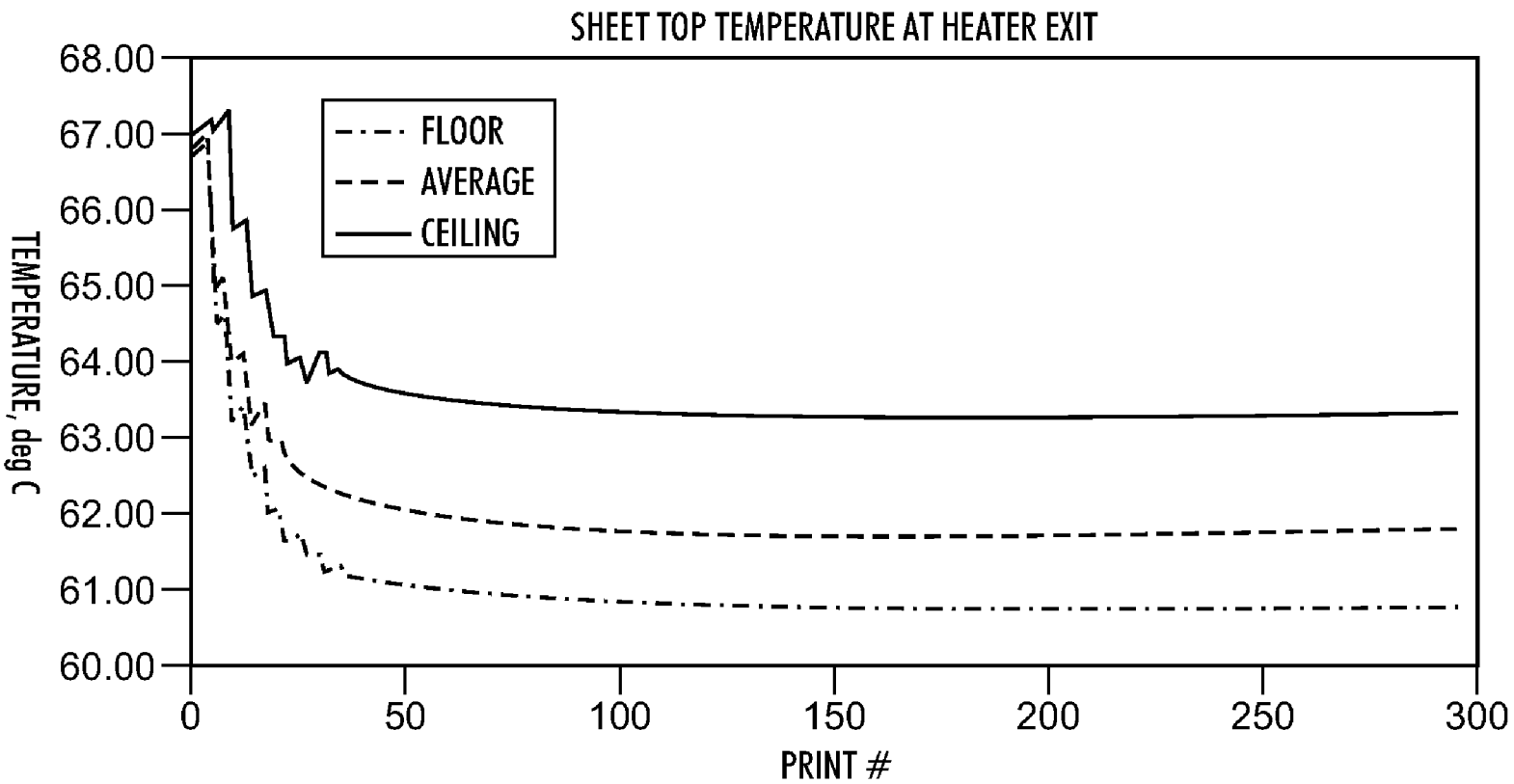
FIG. 11 shows the maximum, minimum and average temperature of the media top surface as a function of sheet number for a Hypalon media transport.
Figure 12:
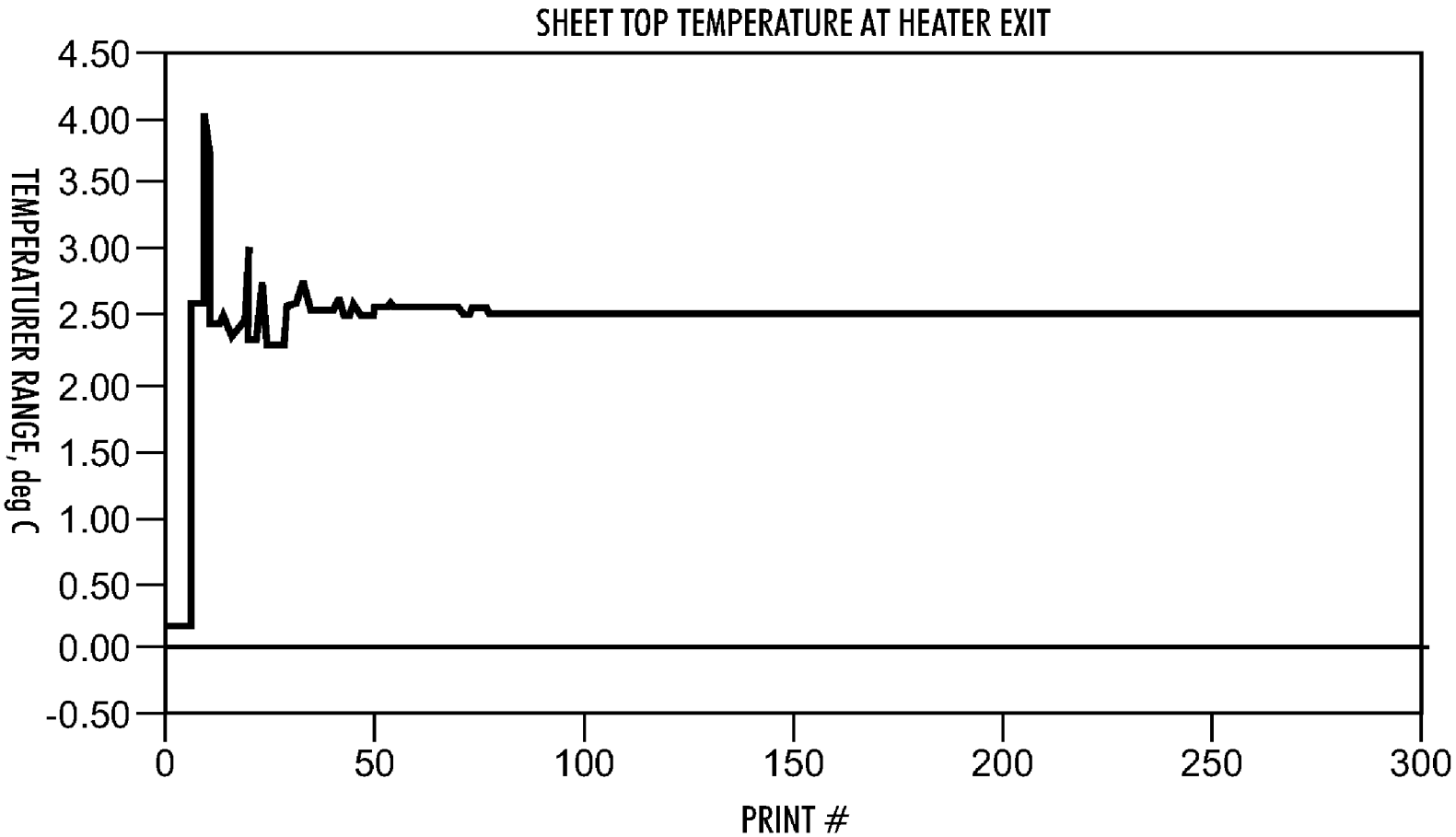
FIG. 12 shows the temperature range (max-min) within a single sheet of paper as a function of sheet number a Hypalon media transport.
Figure 13:
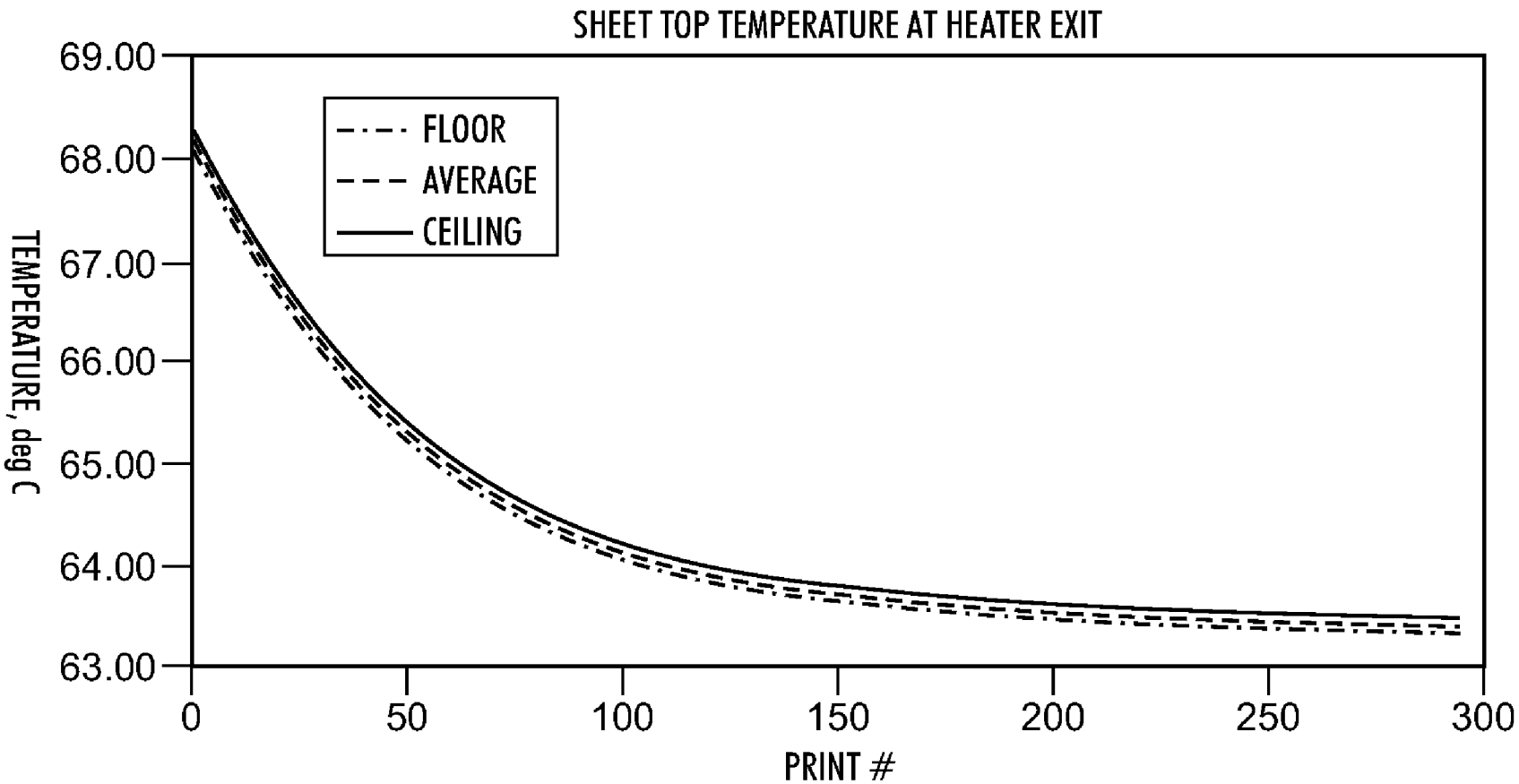
FIG. 13 shows the maximum, minimum and average temperature of the media top surface as a function of sheet number for a Nickel media transport.
Figure 14:
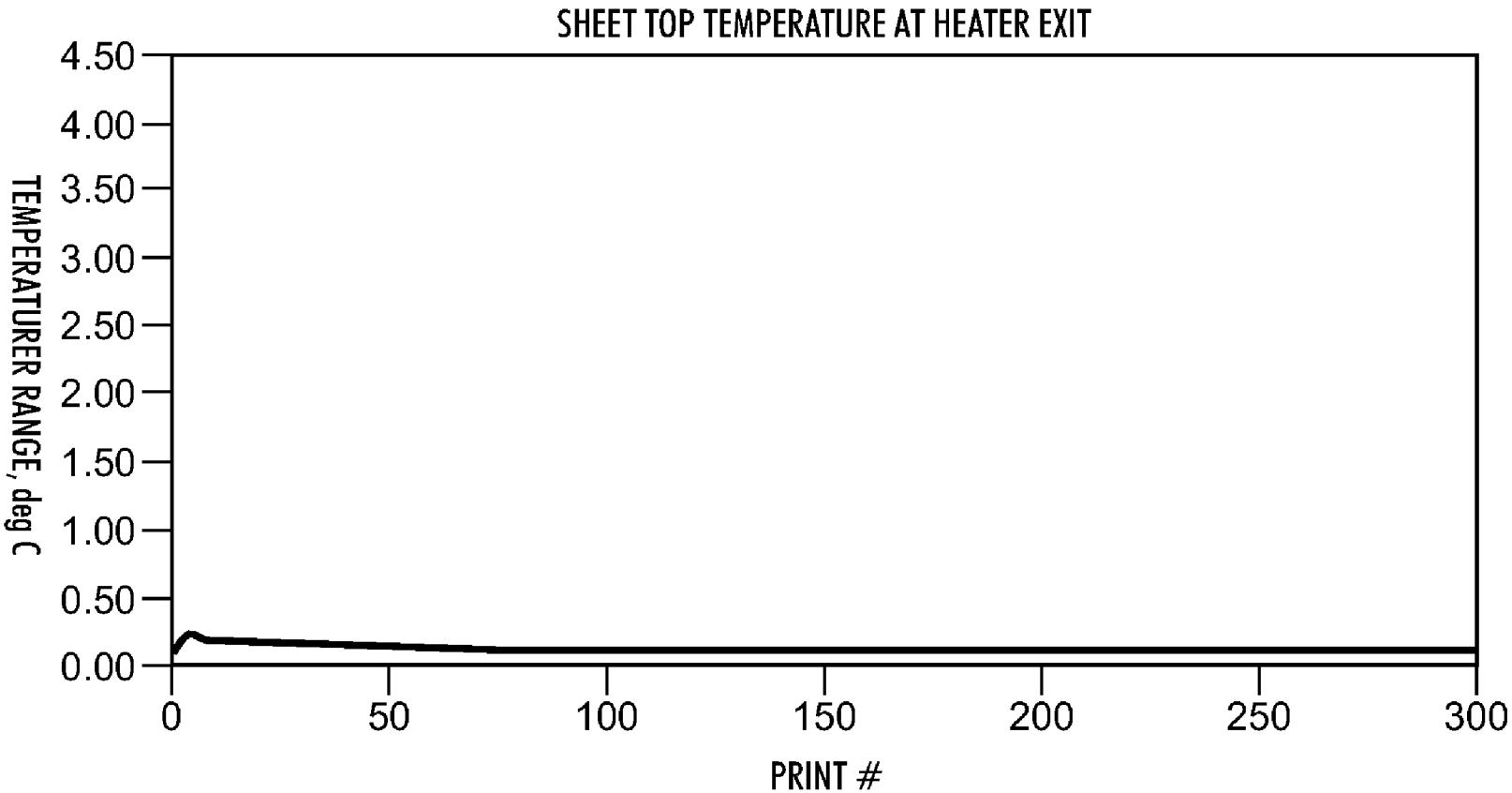
FIG. 14 shows the temperature range (max-min) within a single sheet of paper as a function of sheet number a Nickel media transport.
Figure 15:
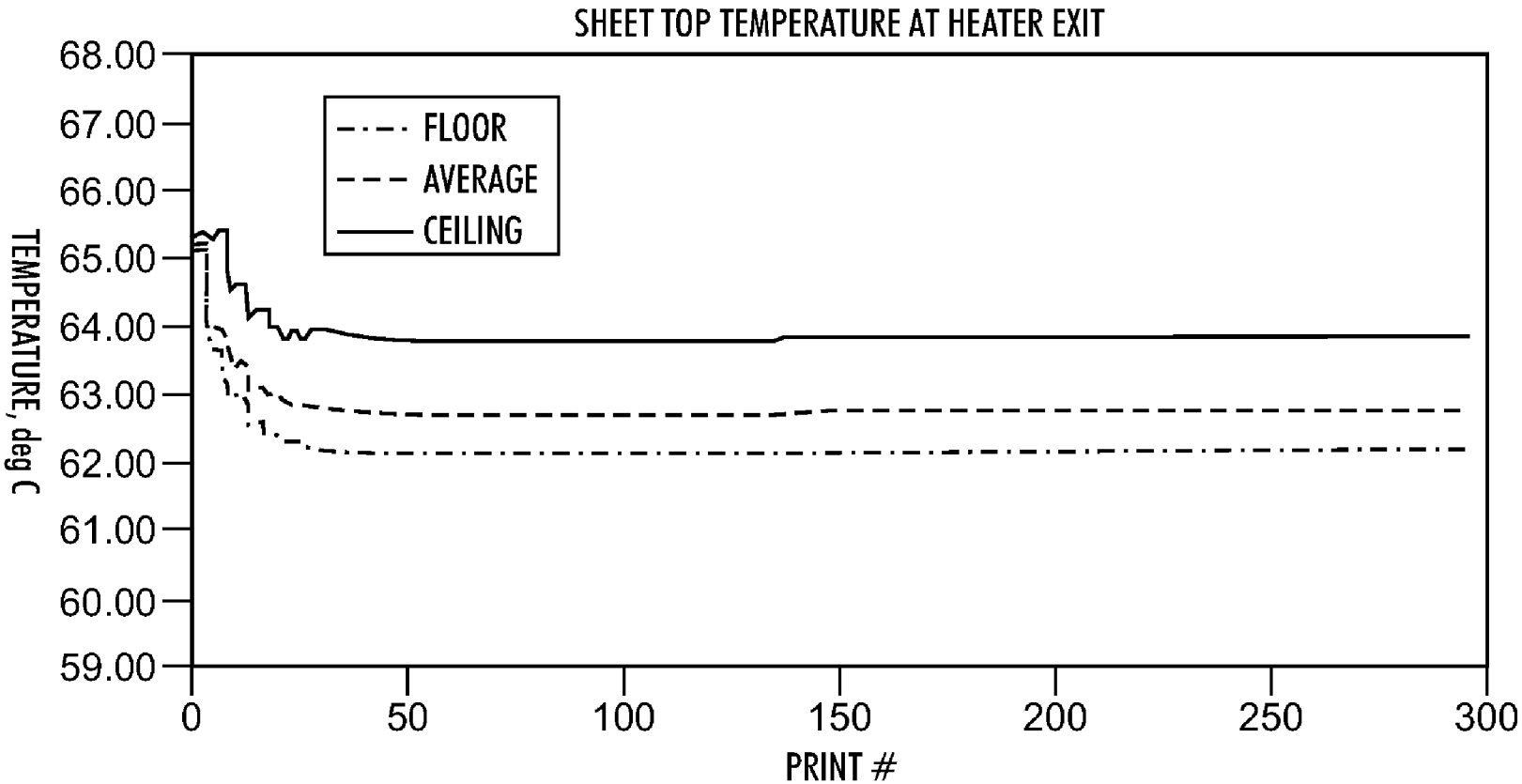
FIG. 15 shows the maximum, minimum and average temperature of the media top surface as a function of sheet number for a Hypalon media transport with a heating/cooling shoe.
Figure 16:
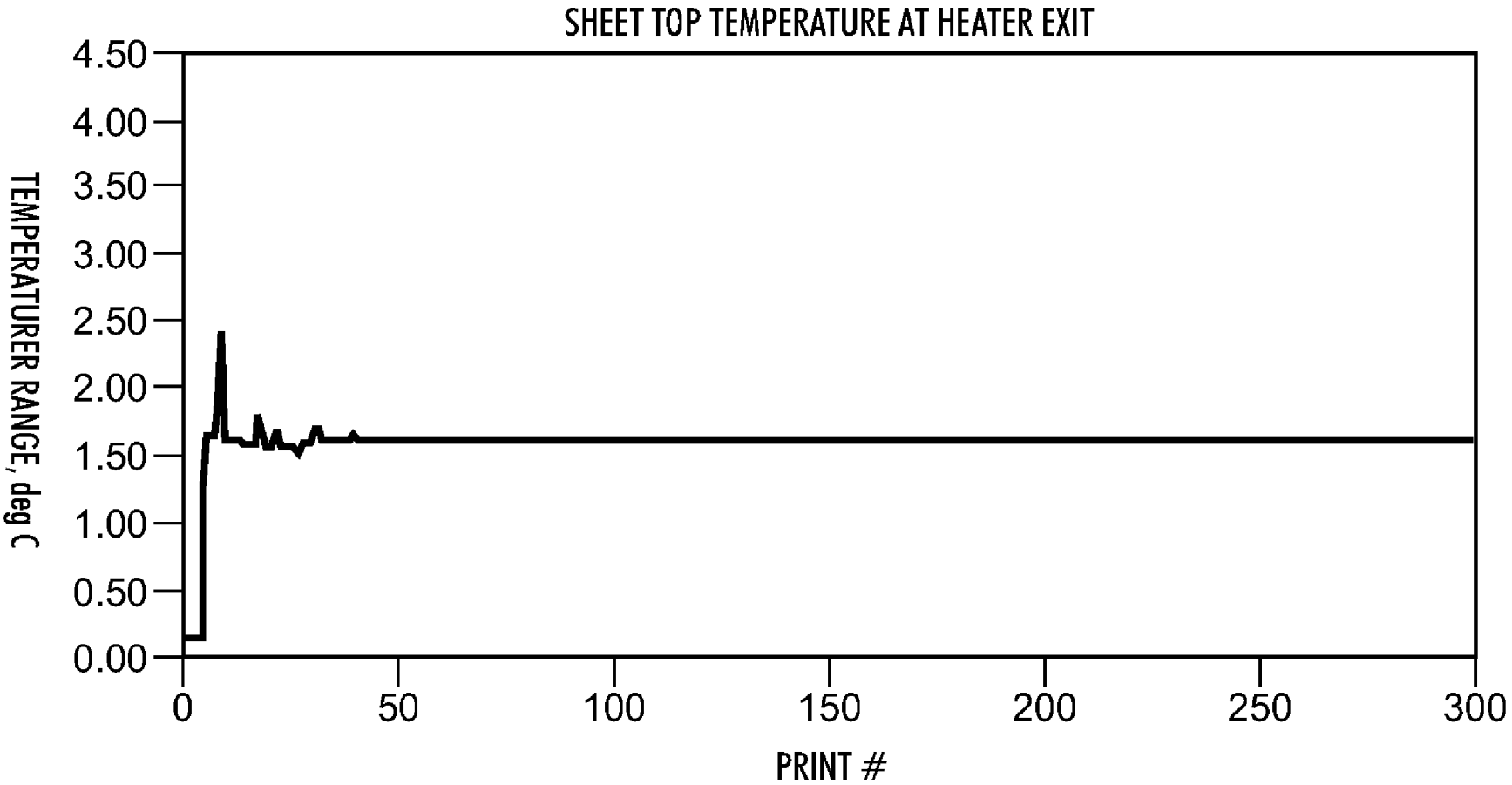
FIG. 16 shows the temperature range (max-min) within a single sheet of paper as a function of sheet number for a Hypalon media transport with a heating/cooling shoe.

Principles of the present invention were simulated numerically using a 3-dimensional heat transfer solver. FIGS. 9-16 illustrate results thereof. FIGS. 9 and 10 show the temperature of the belt surface after a 200 print job when a 0.002 in. Nickel belt is used (FIG. 9) and when a cooling/heating shoe is used (FIG. 10). A comparison of FIGS. 9 and 10 with FIG. 5 shows a definite improvement in the belt surface temperature uniformity in both cases. FIG. 11 shows the maximum, minimum and average temperature of the media top surface as a function of sheet number and FIG. 12 shows the temperature range (max-min) within a single sheet of paper as a function of sheet number for a Hypalon media transport. FIGS. 13 and 14 show the same for a 0.002 in. Nickel media transport and FIGS. 15 and 16 show the same for a Hypalon media transport with a cooling/heating shoe. The improvement in the temperature uniformity of the media transport is directly mapped to a reduction in the within sheet temperature range as can be seen by a comparison of FIGS. 12, 14, and 16 where the within sheet temperature range, i.e. the difference between the maximum and minimum temperature observed with a single sheet at the exit of the heater, is plotted for the three cases under consideration: (a) base case (hypalon belt), (b) metal belt, (c) hypalon belt with cooling/heating shoe.

It is, therefore, apparent that there has been provided in accordance with the present invention a paper preheat transport module that fully satisfies the aims and advantages herein before set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A pre-heater system adapted to be used on an electrostatic marking apparatus for improving gloss on media having marking thereon at a location in said apparatus prior to a conventional fuser roll assembly or station, said system comprising:

a primary heater adapted to blow pressurized hot air into a surface of an image receiving media in order to substantially dispense hot air throughout substantially an entire paper or media surface; and a preheat media transport for transporting media from the location in said apparatus prior to the conventional fuser roll assembly or station through said primary heater, said preheat media transport includes means for maintaining said preheat media transport at a substantially uniform predefined temperature.

2. A pre-heater system of claim 1, wherein said preheat media transport includes an endless belt for transporting media thereon and drive means for moving said endless belt at a predefined velocity.

3. A pre-heater system of claim 2, wherein said preheat media transport further includes a heater for heating said endless belt.

4. A pre-heater system of claim 2, wherein said preheat media transport further includes a cooling system for cooling said endless belt.

5. A pre-heater system of claim 2, wherein said preheat media transport further includes a cooling system for cooling said endless belt and a heater for heating said endless belt.

6. A pre-heater system of claim 2, wherein said preheat media transport further includes a controller, in communication with said heater and said cooling system, said controller activates said heater and said cooling system to maintain a predefined temperature.

7. A pre-heater system of claim 6, wherein said controller adjusts said predefined temperature to a second predefined temperature based the type of media selected.

8. A pre-heater system of claim 2, wherein said heater comprises heat pipe in contact with said endless belt.

9. A pre-heater system of claim 2, wherein said cooling system comprises cooling shoe in contact with said endless belt.

10. A pre-heater system of claim 2, wherein said endless belt includes material having a thermal capacity per surface unit area less than 350 $J/m^2$ K.

11. A pre-heater system of claim 2, wherein said endless belt includes polypropelene.

12. A pre-heater system of claim 2, wherein said endless belt comprises a metal belt.

13. A pre-heater system of claim 12, wherein said metal belt has a Teflon coating.

* * * * *